United States Patent [19]

Spaniola

[11] 3,987,439

[45] Oct. 19, 1976

[54] MULTIPLE MESSAGE DISPLAY FOR A MOTOR VEHICLE

[75] Inventor: James W. Spaniola, Flint, Mich.

[73] Assignee: General Motors Corporation, Detroit, Mich.

[22] Filed: July 3, 1975

[21] Appl. No.: 592,929

[52] U.S. Cl. ..... 340/413; 340/52 F; 340/164 R; 340/168 S; 235/92 PE

[51] Int. Cl.[2] ..... G08B 23/00

[58] Field of Search ..... 340/27 R, 52 F, 223, 340/412, 413, 414, 415, 324 R, 325, 379, 167, 168, 164; 235/150.2, 92 PE

[56] References Cited

UNITED STATES PATENTS

| | | | |
|---|---|---|---|
| 3,087,144 | 4/1963 | Bianchi et al. | 340/213 |
| 3,541,550 | 11/1970 | Hamre | 340/413 |
| 3,582,937 | 6/1971 | Dozer et al. | 340/325 |
| 3,764,984 | 10/1973 | McCartney | 340/168 S |
| 3,798,596 | 3/1974 | Sumiyoshi et al. | 340/52 F |
| 3,803,594 | 4/1974 | Klein et al. | 340/409 R |
| 3,813,525 | 5/1974 | Kitterman et al. | 235/92 PE |
| 3,852,713 | 12/1974 | Roberts et al. | 340/167 R |

*Primary Examiner*—Donald J. Yusko
*Assistant Examiner*—Joseph E. Nowicki
*Attorney, Agent, or Firm*—Warren D. Hill

[57] ABSTRACT

A display indicating events in a motor vehicle includes sensors for signalling the occurrence of each event and a display for sequentially and singly providing at a display window messages corresponding to each sensed event. When an event is sensed, a series of index impulses sequentially indexes the display from a reference condition and simultaneously triggers a counter which registers an output corresponding to each message. A coincidence circuit determines when the counter state is consistent with the sensed event to terminate the index impulse. In the preferred embodiment, the messages are carried by a rotating drum and a switch sensitive to drum position is used to verify that the drum position corresponds to the counter state.

5 Claims, 4 Drawing Figures

MULTIPLE MESSAGE DISPLAY FOR A MOTOR VEHICLE

SPECIFICATION

This invention relates to a multiple message display to singly display messages corresponding to any of a plurality of monitored events.

In the operation of automotive vehicles, increasing use is being made of warning indication devices for indicating the occurrence of events at remote locations. For each event, there is provided a viewing window and a lamp which illuminates a message on the window upon the occurrence of an associated event. Because of the increasing number of these warning devices, the space required for providing all of the desired warning indications becomes increasingly greater. The use of a rotary display device having a plurality of messages spaced therearound representing events which may occur at remote locations in the vehicle permits the use of a single viewing window to provide an indication of the occurrence of any of a plurality of events. This is accomplished by positining the drum adjacent the viewing window, rotating the drum upon the occurrence of an event to position the message representing said occurrence adjacent the viewing window, and illuminating the message when so positioned.

An example of such a device is shown in the U.S. Pat. No. to Pomerantz 3,839,701. As shown in that patent it is the practice to establish the position of the drum and therefore the message in position for display by a large number of electrical switches operated by cams on the drum. At least one switch for each message is required.

It is an object of this invention to provide a display system which monitors the message state of a display system without the requirement of a switch corresponding to each message state of the display unit.

It is another object of this invention to provide a circuit for registering the message selected for display without directly sensing the message state of the display.

The invention is carried out by providing sensors responsive to event occurrences, a circuit responsive to the sensors to produce a pulsed indexing signal, a display unit having message states sequentially advanced by the indexing signal from a reference condition, a counter controlled by the indexing signal to advance the counter state in synchronism with the sequential advance of the message states, and a circuit for comparing the counter state with the sensed event to terminate the indexing signal when coincidence occurs. More particularly, the invention is carried out by providing a rotary drum having a reference position and several message positions wherein the drum is sequentially advanced through message states in response to the indexing signal wherein the counter registers the message state of the drum by monitoring the indexing signal. The invention further contemplates a verification circuit monitoring the display message state and comparing that with the count signal at the time of coincidence to ensure a correct correlation between the two and to return both the counter and the display to the reference state to repeat the indexing process when there is no correlation between the counter and the display state.

The above and other advantages will be made more apparent from the following specification taken in conjunction with the accompanying drawings wherein like reference numerals refer to like parts and wherein.

Figure 1:
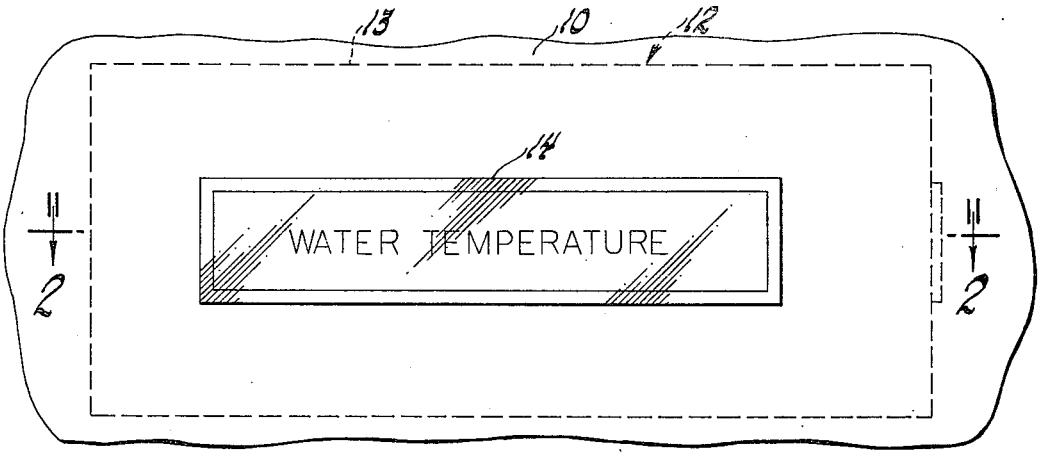
FIG. 1 is a front plan view of a display unit according to the invention set in a vehicle instrument panel.

Referring to FIG. 1, vehicle instrument panel 10 supports a vehicle display unit 12 having a housing 13 and a display window 14 located for viewing by the vehicle operator through an aperture in the instrument panel.

Figure 2:
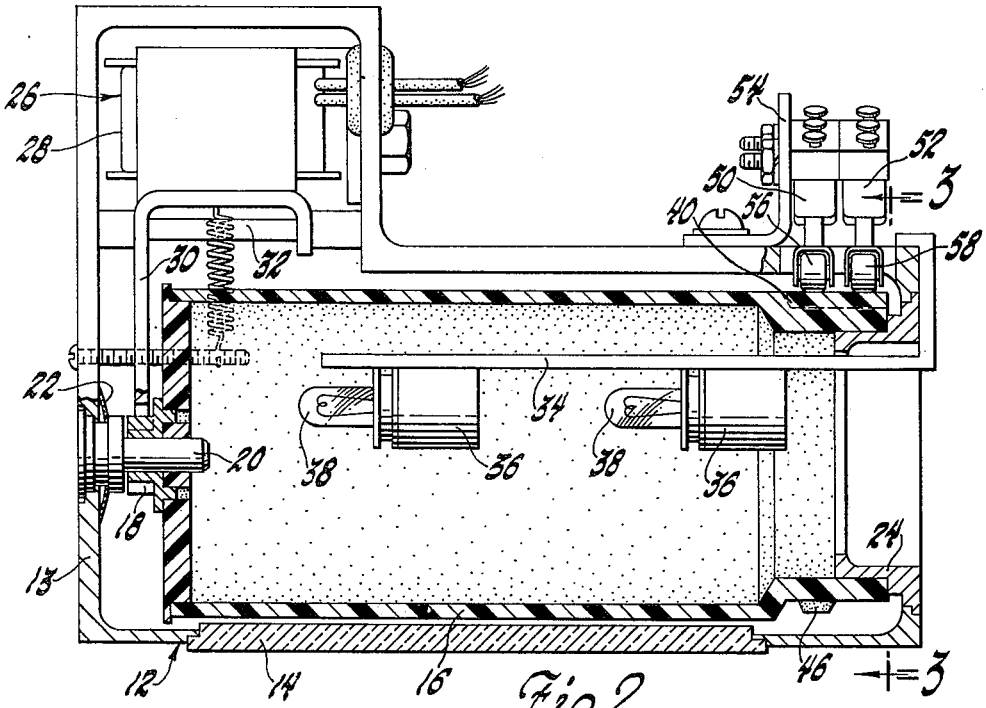
FIG. 2 is a sectional view of the display device according to the preferred embodiment of this invention taken along line 2—2 of FIG. 1.
Figure 3:
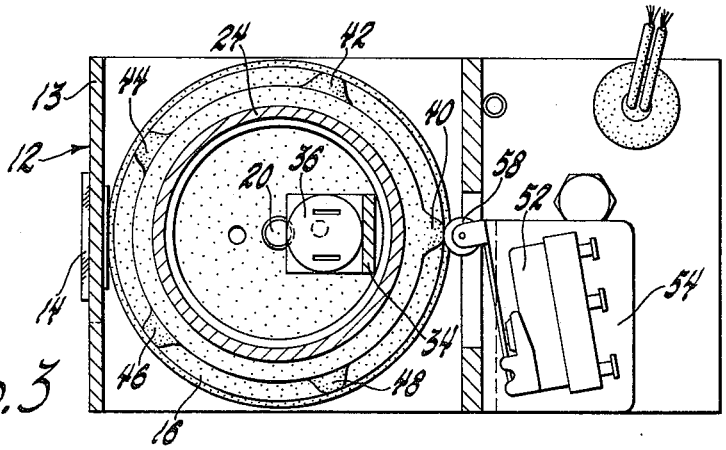
FIG. 3 is an end view of the display device taken along line 3—3 of FIG. 2.

As seen in FIGS. 2 and 3, the vehicle display unit includes a translucent insulating drum 16 having a plurality of messages such as ALTERNATOR, WATER TEMPERATURE, OIL PRESSSURE etc. spaced around. The messages on the drum represent events that may occur in the vehicle. A toothed driven member 18 is secured in a concentric driving relationship to one end of the drum 16. A pin 20 secured to one end of the housing 12 by a fastening ring 22 extends through the toothed driven member 18 to provide a bearing surface and to rotatably support one end of the drum 16. The other end of the drum 16 is supported by an annular extension 24 of the housing. The drum 16 is rotated by a motor 26 secured within the housing. The motor includes a solenoid 28 and an armature 30, the armature being pivotally connected to the housing by a pin 32. One end of the armature 30 engages the teeth of the driven member upon actuation of the solenoid to rotate the drum 16. For each pulse of electrical current to the solenoid 28, the drum will be rotated from one message position to the next and a complete revolution of the drum will occur upon receipt of ten pulses. Thus the drum has 10 position, comprising nine message positions or states and one home or reference position. Further details of the motor and its driving connection to the drum are provided in the U.S. patent to Pomerantz 3,839,701.

The end of the housing opposite the motor supports a lamp holder 34 carrying lamp sockets 36 and lamps 38 for illuminating the message on the drum 16. The end of the drum 16 opposite the driven member 18 carries on its outer periphery 5 equally spaced cams 40, 42, 44, 46 and 48. A verification switch 50 and a home switch 52 are secured to the housing 13 by a bracket 54 and have switch actuating cam followers 56 and 58 respectively for selectively engaging the cams 40 through 48. The cam 40 is sufficiently long to engage both cam followers 56 and 58 whereas the other cams 42 through 48 are shorter and are positioned to engage only the cam follower 56. The home switch 52 then is actuated only when the drum is in its home or reference position shown in the drawings. As the drum 16 is rotated from its reference position through the nine message positions, the verification switch will be actuated only for alternate or even numbered message positions.

Figure 4:
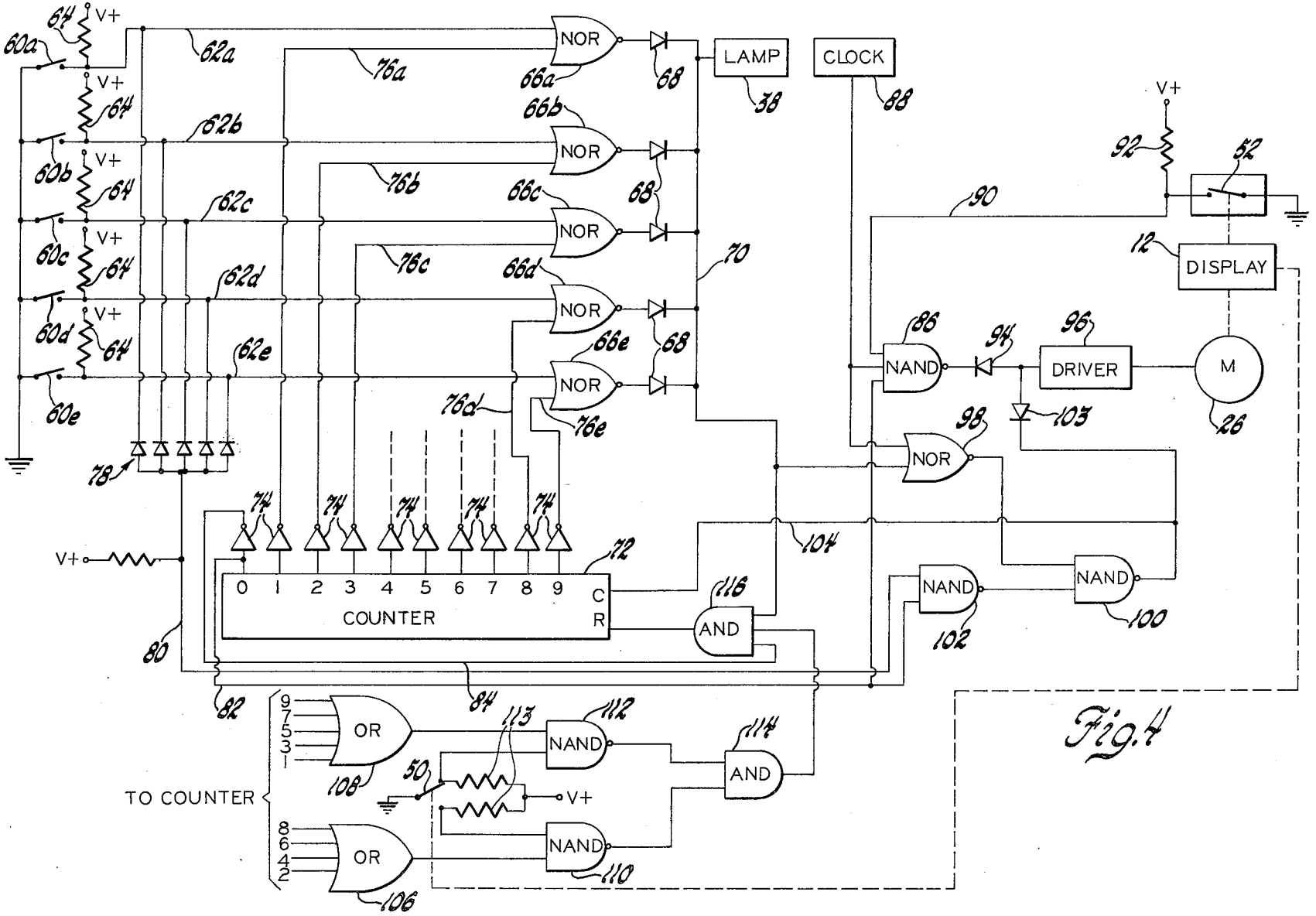
FIG. 4 is a schematic drawing of the circuit for controlling the display device according to the invention.

The control circuit for the display unit is shown in FIG. 4. A plurality of normally open sensor switches **60*a* through 60*e* each are closed in response to the occurrence of an event in the vehicle to selectively connect lines 62*a* through 62*e* to ground. For brevity, only five switches 60 and five lines 62 are shown although in reality, there will be nine switches and lines each corresponding to one of the nine message positions of the drum 16.**

The purpose of the control circuit is to index the display 12 to select and display the appropriate message corresponding to the switch 60 which is closed. In the event more than one switch is closed concurrently, the circuit may include a priority circuit, not shown, which assigns to each switch 60 a priority in accordance with the importance of its respective event and prevents any switch from influencing the control circuit while a switch of higher priority is closed. Each of the lines 62 is connected through a resistor 64 to a voltage V+ so that each line will be at a positive voltage when its respective switch is opened. Each line 62*a* through 62*e* is connected to an input of a respective NOR gate 66*a* through 66*e* which gates in combination comprise a coincidence circuit. Each NOR gate is connected through a diode 68 to a coincidence line 70.

A solid-state decade counter 72 has a series of output terminals denoted 0 – 9. As will be seen, the 0 terminal corresponds to the reference or home state of the drum 16 as well as the reference or home state of the counter and the terminals 1 – 9 correspond to each of the nine message positions or states of the drum 16. Thus a logic 1 output at any of the counter terminals normally indicates that the display drum is in a corresponding position. Each terminal is connected to an inverter 74 which produces a logic signal output opposite to that at its respective terminal. The terminals 1, 2 and 3 are connected through the inverters to lines 76*a*, 76*b* and 76*c* while terminals 8 and 9 are similarly connected to lines 76*d* and 76*e* which are connected to the NOR gate terminals 66*a* and 66*e* respectively. In this abbreviated form of the circuit, the terminals 4 through 7 and their inverters are not shown to be connected to additional NOR gates 66 as they would be in a complete circuit. A plurality of diodes 78, each have their cathodes connected to one of the lines 62*a* through 62*e* and their anodes connected to a line 80 such that line 80 will reflect a low voltage whenever any of the switches 60 are closed thereby providing a warning signal on line 80 when a switch 60 is closed. The 0 terminal of the counter produces a logic 1 signal on line 82 when the counter is in its home or reference state and a logic 1 signal on line 84 when the counter is not in its home state.

A three input NAND gate 86 has one input connected to the line 82, another to a clock 88 and the third to line 90 which is connected to a positive voltage through a resistor 92 and is also connected through the home switch 52 to ground. The home switch is normally closed when the display drum 16 is in home position or reference state. The NAND gate 86 is connected through a diode 94 to the driver circuitry which provides a pulsed output to actuate the motor 26. The drive 96 is actuated when a low voltage or 0 logic signal is present at its input. The NAND gate 86 passes clock pulses to the driver 96 only when the counter is in the home position and the drum is not, so that the drum is indexed until it reaches home position and the switch 52 is closed, whereupon, the NAND gate 86 no longer passes clock pulses and the motor 26 stops. A NOR gate 98 has inputs from the clock 88 and the coincidence line 70 and has its output connected to an input of a NAND gate 100. A NAND gate 102 has its inputs connected to the lines 80 and 82 and its output connected to the second input of the NAND gate 100. The NAND gate 100 has its output connected through the diode 103 to the driver 96.

The operation of the control circuit as thus far described is as follows. Assume that the counter 72 and the display 12 are both in home position and that switch 60*b* is then closed while the other sensor switches remain open: then line 62*b* will be at ground potential while line 62*a*, *c*, *d* and *e* are at some positive potential. Each of the lines 76 is at a logic 1 state so that each of the NOR gates 66 produce a logic 0 output. The ground voltage on line 62*b* is passed to line 80 so that the NAND gate 102 will have a logic 1 output. The line 70 is at logic 0 state so that the clock pulses from the clock 88, which alternate between 0 and 1 state, are passed through the NOR gate 98 and through the NAND gate 100 to pulse the driver 96 and actuate the motor 26 to index the display 12 one position for each clock pulse. The pulsed output from the NAND gate 100 is connected by line 104 to the count input C of the counter 72 so that for each clock pulse, the counter will advance one state thereby advancing synchronously with the drum 16. After two pulses, the line 76*b* will achieve a logic 0 state. The coincidence of a 0 state on lines 62*b* and 76*b* is detected by the NOR gate 66*b* to produce a logic 1 or coincidence signal on line 70, which disables the NOR gate 98 to prevent any further clock pulses from reaching the NAND gate 100. Then the motor 26 will stop and the message on the drum 16 which is two positions from the home position will be at the display window 14. At the same time, the telltale lamps 38 which are connected to the coincidence line 70 will be illuminated to display the selected message.

When the sensed condition has been corrected, the switch 60*b* will open to remove the warning signal on line 80 and to remove the coincidence signal on line 70. The line 82 will be at a logic 0 state since the counter is not in its home state so that again the NAND gate 102 produces a 1 output and the clock pulses are fed to the NOR gate 98 and the NAND gate 100 to pulse the display and the counter back to home position. Then the line 82 will have a high state as does line 80 so that the NAND gate 102 will have a logic 0 output to prevent clock pulses from passing through NAND gate 100. The operation of the NAND gate 86 as explained above assures that whenever the counter is in its home position, the drum 16 will also be in its home position as determined by the home switch 52. Thus a large number of events may be singly indicated by the display device and only one switch associated with the display device is necessary regardless of how many message states are available in the display unit.

Depending on the design of the motor 26 and its driving connections with the drum 16, there is a possibility that the motor will fail to respond to an occasional pulse during the message selection process so that the counter 72 will be one step ahead of the display. The following verification circuit is proposed to determine if the counter and display are in phase every time a coincidence signal is produced and if they are not in phase, to return the drum and counter to home positions and repeat the indexing process. Each of the counter terminals 2, 4, 6 and 8 are connected to the input of an OR gate 106 while the odd numbered terminals are connected to OR gate 108. The OR gate outputs are connected to inputs of NAND gate 110 and 112, respectively. The verification switch 50 selectively connects another input of each of the NAND gates 110 and 112 to ground while the NAND gate terminal not connected to ground is connected through a resistor 114 to a positive voltage. When the drum is in home position or in any even numbered position, one of the cams 40 through 48 actuates the switch 50 to ground an input of NAND gate 112 as shown in FIG. 4. The output of the NAND gates 110 and 112 are fed to the inputs of an AND gate 114, which in turn has an output connected to an input of an AND gate 116 which also has inputs from the coincidence line 70 and line 84. The output of AND gate 116 is connected to a reset input R of the counter 72 whereupon the counter is reset to 0 state when the reset input is energized. When the counter is in a 2, 4, 6 or 8 state, the OR gate 106 will pass a logic 1 signal to the NAND gate 110. If the display drum is in an even message position, the verification switch 50 will not ground the other input of the NAND gate 110 so that a logic 1 signal is supplied to that input. The NAND gate therefore has a logic 0 output as will the NAND gates 114 and 116.

If, however, the drum is in an odd message position while the counter is in an even state, then the switch 50 will ground one input of the NAND gate 110 to produce a logic 1 signal at the output of NAND gate 110 and the NAND gate 112 will similarly produce a logic 1 output since this input from the OR gate 108 will be 0 and its other input will be at a logic 1 level. Thus, the AND gate 114 will produce a logic 1 output as well as the AND gate 116, provided there is a coincidence signal on line 70 and provided the counter is not at its home state as indicated by a logic 1 signal on line 84. Thus, the counter is reset to its 0 or home state. Then the NAND gate 86 will pass clock pulses to index the display 12 until the display reaches its home position as sensed by the closing of the switch 52. Thereafter the counter and the display are indexed again until coincidence is found. Similarly, if at the time of coincidence, the counter is in an odd numbered state and the verification switch indicates that the counter is in an even numbered state, then the counter will be reset and the cycle repeated.

Thus, it will be seen that when the verification circuit is used, a total of two cam operated switches are required to sense the drum position even though a very large number of messages are available for display by the drum. This eliminates a large number of mechanical switches required by previous systems which use at least one switch for each message position.

The embodiments of the invention in which an exclusive property or privilege is claimed are defined as follows:

1. A multiple message display to singly display at a display location any one of a plurality of messages corresponding to monitored events comprising a plurality of on-off event sensors each corresponding to a message and each for providing an "on" event signal upon the occurrence of a sensed event, means responsive to any "on" event signal effective to provide a time succession of pulses, a display unit having a plurality of message states corresponding to each of said event sensors, respectively, means responsive to the succession of pulses effective to advance the display unit through said message states in sequence, and means including a counter having a plurality of sequentially selected states, the counter being responsive to the succession of pulses to advance the counter state in synchronism with the advance of the display unit and to terminate said pulses to produce and maintain a sensible display in response to an "on" event signal at the sensor corresponding to the particular counter state.

2. A multiple message display to singly display at a display location any one of a plurality of messages corresponding to monitored events comprising a plurality of on-off event sensors each corresponding to a message and each for providing an "on" event signal upon the occurrence of a sensed event, means responsive to any "on" event signal effective to provide a time succession of pulses, a display unit having a plurality of message states corresponding to each of said event sensors, respectively, means responsive to the succession of pulses effective to advance the display unit through said message states in sequence, means including a counter having a plurality of sequentially selected states, the counter being responsive to the succession of pulses to advance the counter state in synchronism with the advance of the display unit, a coincidence circuit responsive to the event signal and the counter state for terminating said pulses when the counter state corresponds to an "on" event signal at the sensor to maintain the display at the particular message state, and means responsive to the coincidence circuit for energizing the display unit to produce a sensible display.

3. A multiple message display to singly display at a display location any one of a plurality of messages corresponding to monitored events comprising a plurality of on-off event sensors each corresponding to a message and each for providing an "on" event signal upon the occurrence of a sensed event, means responsive to any "on" event signal effective to provide a time succession of pulses, a display unit having a plurality of message states corresponding to each of said event sensors, respectively, and further having a reference state, a counter having a state corresponding to each message and reference state of the display unit, synchronizing means effective only when the counter is in its reference state and the display unit is not in its reference state to advance the display unit to its reference state, means responsive to the succession of pulses to advance the display unit from its reference state through said message states in sequence, and means responsive to the succession of pulses to advance the counter state from its reference state in synchronism with the advance of the display unit and to terminate said pulses to produce a sensible display in response to an "on" event signal at the sensor corresponding to the particular counter state.

4. A multiple message display to singly display at a display location any one of a plurality of messages corresponding to monitored events comprising a plurality of on-off event sensors each corresponding to a message and each for providing an "on" event signal upon the occurrence of a sensed event, means responsive to any "on" event signal effective to provide a time succession of pulses, a display unit having a plurality of message states corresponding to each of said event sensors, respectively, the display unit having a reference state and the message states occurring in sequence and having assigned thereto alternate odd and even designations, a counter having odd and even states corresponding to the message states of the display unit and having a reference state, means responsive to the succession of pulses to advance the display unit from its reference state through said odd and even message states in sequence, means responsive to the succession of pulses to advance the counter state from its reference state in synchronism with the advance of the display unit, means for terminating said pulses when a counter state corresponds to an "on" event signal at the sensor to maintain the display at a particular message state, and verification means enabled when the pulses are terminated for comparing the odd or even designation of the particular message state to the odd or even designation of the particular counter state to verify correspondence of the counter and message states, and for resetting the counter and the display unit to their respective reference states in the absence of correspondence of the counter and message states.

5. A multiple message display to singly display at a display location any one of a plurality of messages corresponding to monitored events comprising a plurality of on-off event sensors each corresponding to a message and each for providing an "on" event signal upon the occurrence of a sensed event, means responsive to any "on" event signal effective to provide a pulsed indexing signal, a rotary display drum having a plurality of message positions each carrying a message, and a reference position, a display location adjacent the display drum, an actuator drivingly connected to the display drum and actuated by the indexing signal to advance the drum from its reference position and sequentially advance the messages to the display location, first and second switches, cam means rotatable with the display drum for actuating the first switch when the drum is in the reference position and for selectively actuating the second switch at alternate odd or even message positions, a solid state counter having a message state and a reference state corresponding to each message position and the reference position respectively of the display drum, a synchronizing circuit effective only when the counter is in its reference state and the first switch is not actuated for energizing the actuator to advance the drum to its reference position, means responsive to the indexing signal to advance the counter state from its reference state through alternate odd and even states in synchronism with the advance of the display drum, a coincidence circuit for terminating the indexing signal when a counter state corresponds to an "on" event signal at the sensor to maintain a particular message at the display location, and a verification circuit including the second switch and enabled by the coincidence circuit for comparing the odd or even state of the particular message position with the odd or even state of the counter to verify correspondence of the counter state and displayed message, and for resetting the counter and the display drum to their respective reference state and position in the absence of correspondence of the counter state and message position.

* * * * *